United States Patent [19]

Eckel

[11] 4,404,876

[45] * Sep. 20, 1983

[54] POWER TONGS

[75] Inventor: Emery L. Eckel, Odessa, Tex.

[73] Assignee: Eckel Manufacturing Co., Inc., Odessa, Tex.

[ * ] Notice: The portion of the term of this patent subsequent to Apr. 11, 1995, has been disclaimed.

[21] Appl. No.: 135,176

[22] Filed: Mar. 28, 1980

Related U.S. Application Data

[63] Continuation of Ser. No. 906,200, May 15, 1978, abandoned, which is a continuation of Ser. No. 698,324, Jun. 22, 1976, Pat. No. 4,089,240, which is a continuation-in-part of Ser. No. 671,959, Mar. 30, 1976, Pat. No. 4,084,453.

[51] Int. Cl.[3] ..... B25B 17/00

[52] U.S. Cl. ..... 81/57.18; 81/57.21

[58] Field of Search ..... 81/57.18, 57.21

[56] References Cited

U.S. PATENT DOCUMENTS

| | | | |
|---|---|---|---|
| 2,550,045 | 4/1951 | DeHetre | 81/57.18 |
| 2,846,909 | 8/1958 | Mason | 81/57.18 |
| 3,371,562 | 3/1968 | Kelley | 81/57.18 |
| 3,550,485 | 12/1970 | Dickmann | 81/57.18 |
| 3,589,742 | 6/1971 | Flick | 81/57.18 |
| 3,635,105 | 1/1972 | Dickmann et al. | 81/57.18 |
| 4,084,453 | 4/1978 | Eckel | 81/57.18 |

*Primary Examiner*—James L. Jones, Jr.

*Attorney, Agent, or Firm*—Carwell & Helmreich

[57] ABSTRACT

A power tong includes a frame and a pipe-gripping mechanism associated with a throat at one end of the frame. Power is transmitted to the pipe-gripping mechanism from a power unit through a drive train. The pipe-gripping mechanism cooperates with the throat to receive a pipe section to be rotated and includes a partial ring rotatably mounted within the frame and having an opening which may be aligned with the throat. The ring may be rotated in either direction by the power unit. Mounted on the tong is a die carrier which is rotatable relative to the ring. Die members are mounted on the die carrier and include dies positioned to grip the external surface of the pipe section. The die members are arranged to cooperate with cam surfaces on the ring so that, when the ring is rotated relative to the die carrier, the dies are moved rectilinearly into engagement with the pipe section. After the movable dies have engaged the pipe section further relative movement between the ring and the die carrier is prevented and the pipe section is therefore rotated to make up or break apart the threaded joint of pipe

6 Claims, 4 Drawing Figures

POWER TONGS

CROSS REFERENCE TO RELATED APPLICATION

This application is a continuation of application Ser. No. 906,200, filed May 15, 1978, now abandoned, which, in turn, is a continuation of application Ser. No. 698,324, filed June 22, 1976 and is now U.S. Pat. No. 4,089,240 issued May 16, 1978, which, in turn, is a continuation-in-part of application Ser. No. 671,959, filed Mar. 30, 1976 and is now U.S. Pat. No. 4,084,453, issued Apr. 18, 1978.

BACKGROUND OF THE INVENTION

The present invention relates to power tongs of the type commonly used in oil fields for making up and breaking apart threaded connections between drill pipes, tubing, and the like.

It is frequently necessary in oil field operations to connect or disconnect joints of pipe which are threadedly connected together. Strings of drill pipes, for example, comprise a series of pipe sections joined together at their ends. Power tongs are employed for making up and breaking apart these connections and are used to rotate the pipes relative to each other. A typical power tong includes a mechanism for gripping the external surface of a pipe section and then rotating the pipe section while the pipe section to which it is connected is held stationary or rotated in the opposite direction.

A variety of power tong constructions have been developed for accomplishing this result. U.S. Pat. No. 2,879,680 to Beeman et al, which is assigned to the present inventor, is illustrative of one type of tong construction. Although devices of this type have proved satisfactory for most oil field operations, extensive use and experimentation has shown that improvements are needed, particularly with respect to the pipe-gripping mechanism and the means for urging the mechanism into contact with the pipe.

Accordingly, an object of the present invention is to provide a power tong for making up and breaking apart joints of drill pipe, tubing, and the like having an improved pipe-gripping mechanism.

Another object of the invention is to provide a power tong having improved means for actuating the pipe-gripping mechanism in order to better grip and rotate the sections of pipe relative to each other.

Yet another object of the invention is to provide a power tong having means for moving the dies rectilinearly into engagement with the pipe section.

These together with other objects and advantages of the invention will become more apparent upon reading the undergoing specification and claims.

SUMMARY OF THE INVENTION

A power tong is provided in accordance with the present invention which includes a frame having a pipe-gripping mechanism associated with a throat defined at one end of the frame. Power is transmitted to the pipe-gripping mechanism from a power unit through a drive train.

The pipe-gripping mechanism cooperates with the throat to receive a pipe section to be rotated. The pipe-gripping mechanism includes a partial ring rotatably mounted within the frame and having an opening which may be aligned with the throat so that the pipe section may be positioned within the ring. This ring may be rotated in either the clockwise or counterclockwise direction by the power unit and drive train which cooperates with gear teeth rigidly fixed to the ring.

A die carrier is mounted on the tong and is rotatable relative to the ring. The die carrier includes die members which are mounted on the carrier and have dies positioned to grip the external surface of the pipe section which is to be rotated. The die members are arranged to cooperate with cam surfaces on the ring so tat, when the ring is rotated relative to the die carrier, the dies are moved rectilinearly into engagement with the pipe section. After the movable dies have engaged the pipe section, further relative movement between the ring and the die carrier is prevented and the pipe section is therefore rotated to make up or break apart a threaded joint of pipe.

DESCRIPTION OF THE PREFERRED EMBODIMENTS

Figure 1:
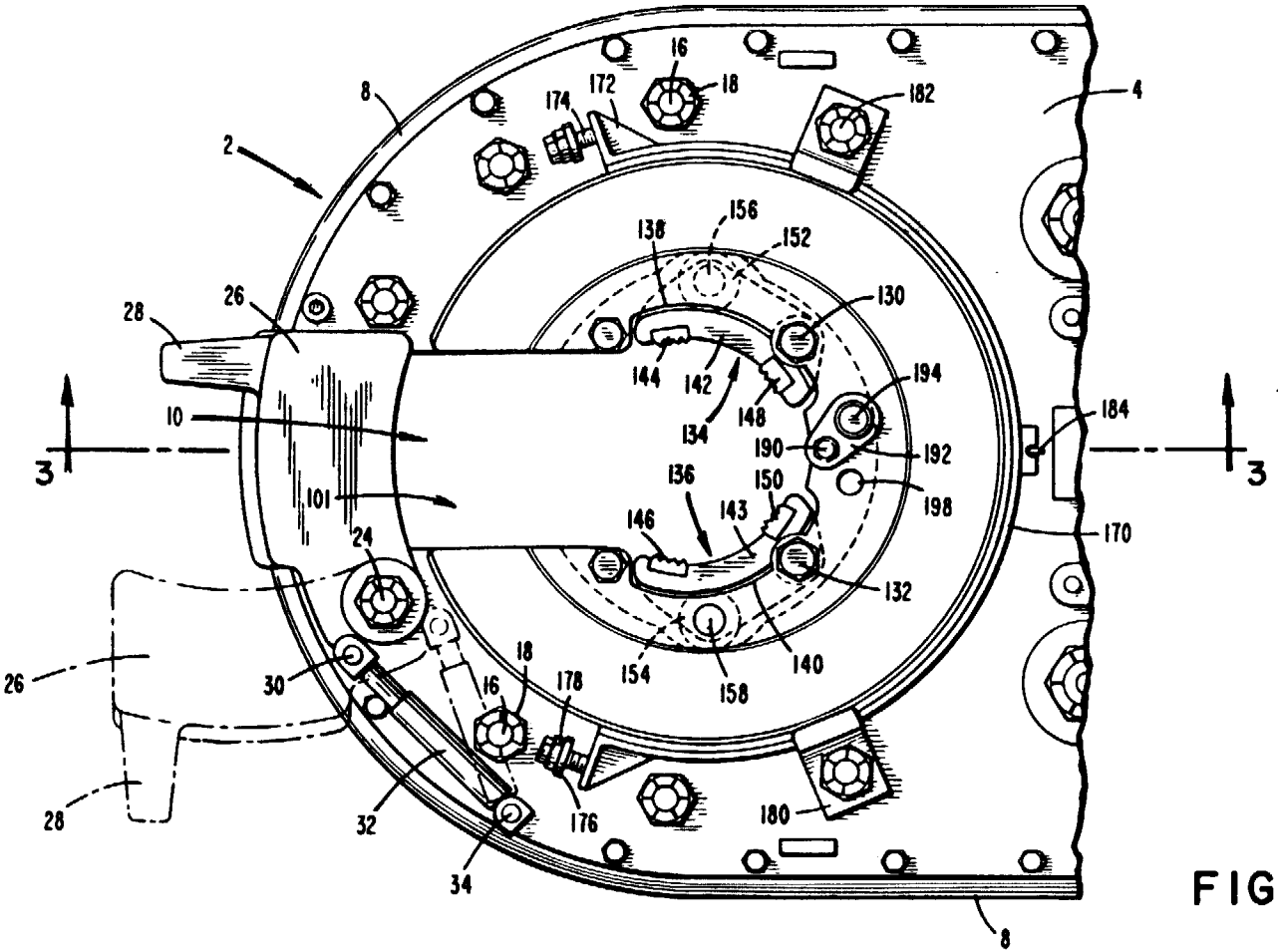
FIG. 1 is a plan view of the front portion of a power tong according to the invention.

Referring now in detail to the drawings, the frame 2 of the power tong includes an upper plate 4 and a lower plate 6 spaced apart and bolted to the sidewalls 9. The frame 2 has an arcuate front portion defining a throat 10 for receiving a pipe section such as a section of drill pipe, tubing or the like. Mounted around the inner periphery of the front portion of the frame 2 are a plurality of rollers 12 and 14. The rollers 12 are mouned on the bottom side of the upper plate 4 and the rollers 14 on the top side of the lower plate 6. The rollers 12 and 14 are mounted in suitable bearings on a common shaft 16 which is threaded at both ends and which receives retaining nuts 18. Rollers 12 and 14 are retained in position by shoulders 20 and 22, respectively, of shaft 16.

Pivotally mounted to the frame 2 adjacent the throat 10 by means of a hinge pin 24 is a door 26 which may be opened by means of handle 28 to allow a section of pipe to be placed in the throat 10 of the power tong. Pivotally attached at 30 to the door 26 is one end of a spring-loaded piston assembly 32. The other end of the piston assembly 32 is pivotally attached at 34 to the frame in order to retain the door in the open or closed position. The door and piston assembly are shown in the closed position in solid lines and in the open position in phantom lines. Optionally, the door 26 may include a latch mechanism (not shown) which cooperates with a corresponding hook (not shown) mounted on the frame 2 so that the door 26 can be securely locked in place after a pipe section has been placed into the throat 10.

The pipe-gripping mechanism includes a partial ring 40 which comprises a rotary gear mounted for rotation within the frame 2 and has an opening 42 which is adapted to align with the throat 10 of the frame. The ring 40 is guided on its outer periphery and retained within the frame 2 by the rollers 12 and 14. More particularly, the ring 40 includes a projection 44 which extends around the outer circumference of the ring and defines upper and lower shoulders 46 and 48, respectively, which abut against rollers 12 and 14, respectively. Rigidly secured to the outer periphery of the projection 44 of the ring 40 are gear teeth 50.

Figure 2:
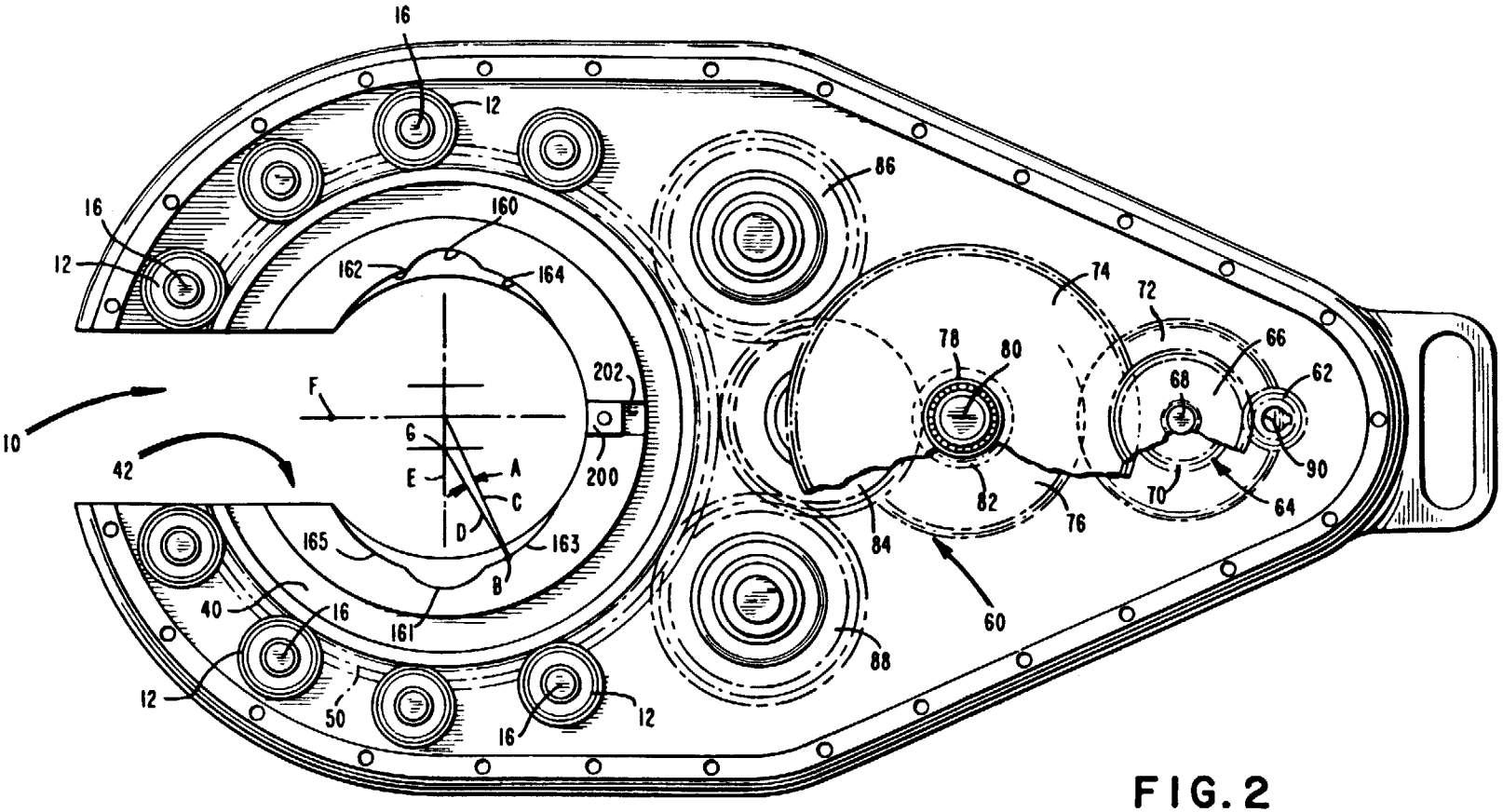
FIG. 2 is a plan view of the entire power tong of FIG. 1 with the top plate of the frame, the door and the die carrier removed.
Figure 3:
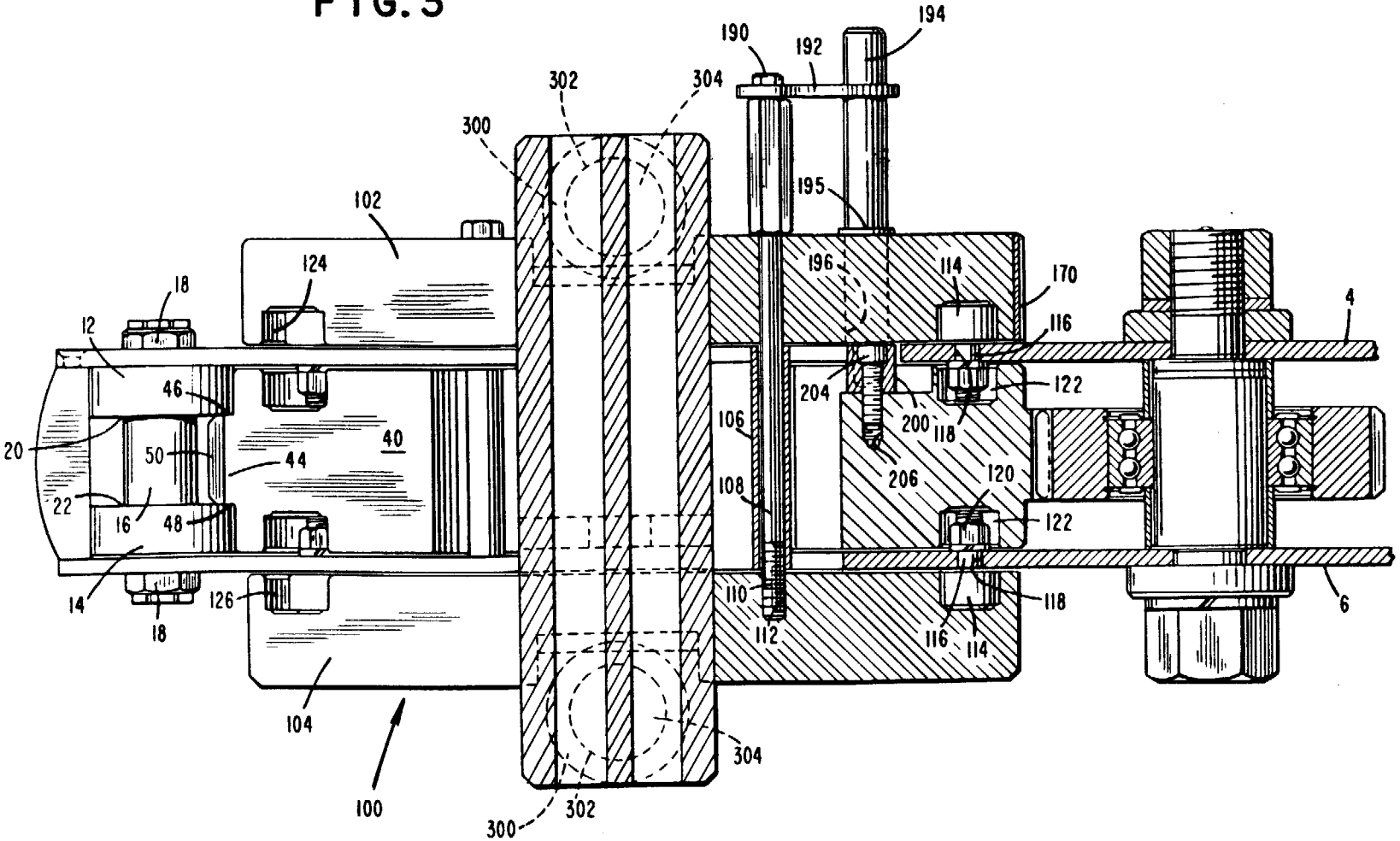
FIG. 3 is a vertical cross-section view taken along the line 3—3 in FIG. 1.

The ring 40 may be rotated relative to the frame 2 by means of drive train 60 shown in FIG. 2. The drive train 60 includes a motor drive gear 62 which engages a clutch assembly 64. More particularly, the motor drive gear 62 meshes with the clutch drive gear 66 which is rigidly attached to clutch shaft 69. The clutch assembly also includes a low speed clutch gear 70 and a high speed clutch gear 72 which can be selectively actuated by moving a shifting collar (not shown) which surrounds clutch shaft 68 by means of a conventional shifting assembly (not shown). The low and high speed clutch gears 70 and 72 mesh with low and high speed pinion gears 74 and 76, respectively. The low and high speed pinion gears 74 and 76 are carried by a sleeve 78 rotatably mounted upon a bearing post 80. The sleeve 78 includes gear teeth 82 which mesh with pinion idler gear 84. The pinion idler gear 84 in turn drives rotary idler gears 86 and 88 which mesh with the gear teeth 50 on the ring 40. The drive train is powered by a motor which has not been illustrated in the drawings. However, it will be understood that any conventional motor may be employed which is capable of rotating the motor drive gear 62 in either direction. The drive shaft of the motor fits into the keyed opening 90 of the motor drive gear.

The pipe-gripping mechanism further includes a die carrier 100 which is mounted for rotation on the tong and has an opening 101 which is adapted to align with the throat 10 of the frame and the opening 42 of the partial ring. The die carrier 100 includes upper and lower arcuate plates 102 and 104, respectively, spaced apart by spacer sleeves 106. The plates 102 and 104 are held in position by bolts 108 which have a lower threaded end portion 110 which is threaded into a threaded opening 112 in lower arcuate plate 104. The upper and lower plates 4 and 6 of the frame 2 have a plurality of guide wheels 114 rotatably mounted thereon. The guide wheels 114 are rotatably mounted on shafts 116 by means of suitable bearings. The shafts 116 extend through openings 118 in the upper and lower plates 4 and 6 and are retained by nuts 120 housed in grooves 122 in ring 40. These guide wheels 114 ride in grooves 124 and 126 defined in the lower and upper surfaces, respectively, of the upper and lower plates 102 and 104, respectively. This construction permits the partial ring 40 and the die carrier 100 to rotate relative to one another. As will be appreciated, the grooves 124 and 126 may be defined in the upper and lower surfaces of the partial ring 40 and the guide wheels 114 rotatably mounted on the die carrier 100 so that the die carrier is rotatably mounted on the partial ring rather than the frame.

Mounted on the die carrier 100 are a pair of die members 134 and 136, respectively. The die members each include similarly shaped upper and lower arcuate wall portions 301. The die members also each include a cylindrically shaped side wall portion 142 and 143, respectively. Each of the die members 134 and 136 normally carries a front die 144 and 146, respectively, a rear die 148 and 150, respectively and center dies 145 and 149, respectively. The dies are mounted on the side portions 142 and 143. Each of the die members 134 and 136 also includes head rollers 152 and 154, respectively, which are rotatably mounted by head roller pins 156 and 158, respectively, between the arcuate upper and lower wall portions 301 and act as cam followers. The dies are typically provided with serrated faces which grip the pipe section. Although front, rear, and center dies have been illustrated, it will be appreciated that each of the die members 134 and 136 may only carry one die with the dies mounted in opposed relationship.

Figure 4:
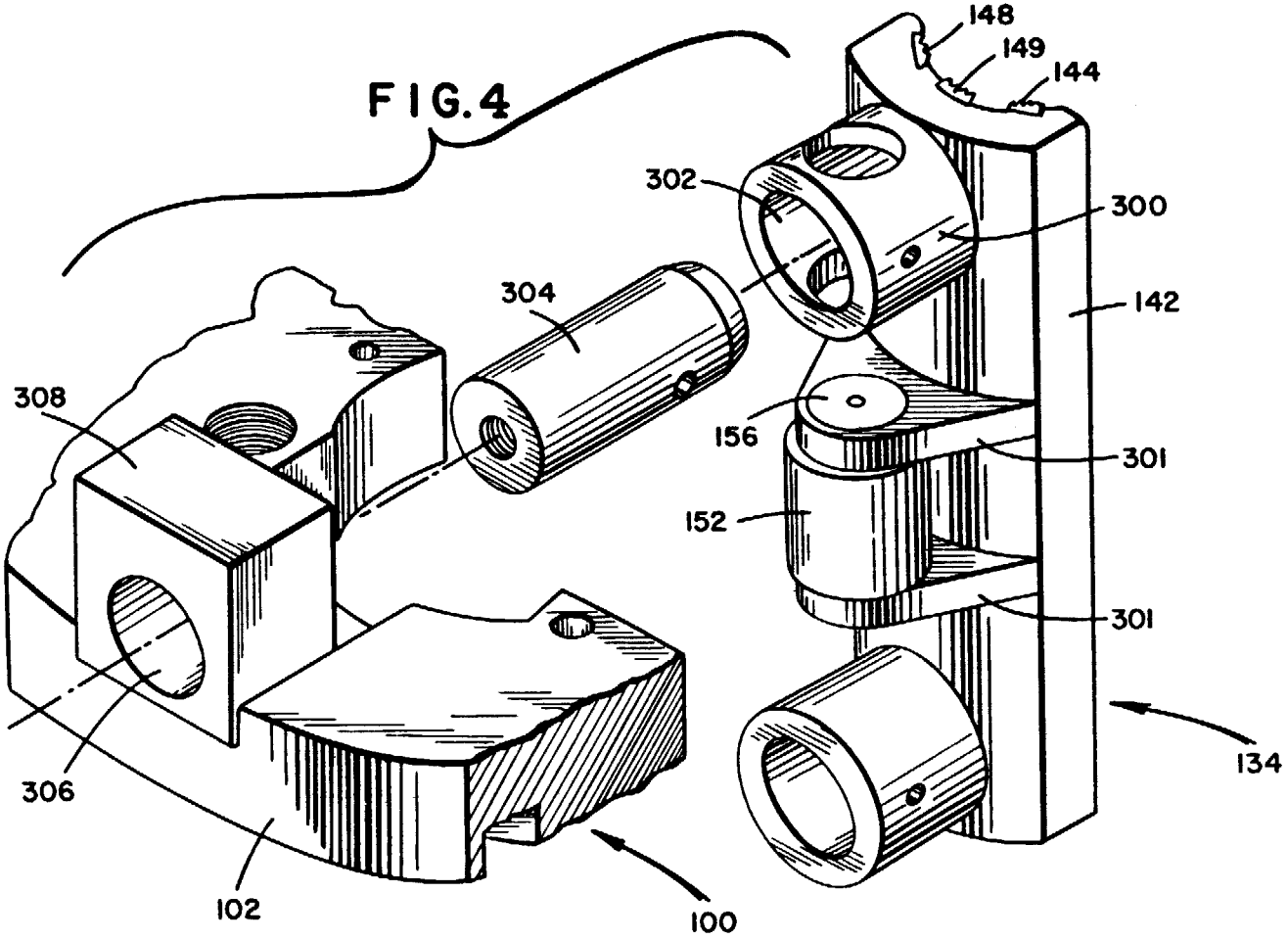
FIG. 4 is a perspective view of one of the die members.

Each die member further comprises a pair of die member guides 300 which include a guide passage 302 for receiving a guide rod 304. While only one die member guide 300 mounted above the upper wall portion 301 is shown in FIG. 4, there is provided a second die member guide located just below the lower wall portion 301, and is identically constructed to guide 300 and operates in the same manner. The die member guide 300 can be inset into the side wall portion 142 of die members, and the guide passage 302 can also extend into the side wall portion 142. The guide rod 304 is fixedly mounted within the guide passage 302. One mode of mounting the guide rod is to thread one end of the guide rod 304 and the guide passage 302 so that the rod can be screwed into the passage. Another embodiment, not shown, is to connect the guide rod 304 directly to the side wall portion 142, thereby eliminating the need for the guide 300.

The die carrier 100 further includes a guide passage 306 adapted to receive the guide rod 304. The guide passage 306 can be associated with a die carrier block 308, physically connected to the upper plate 102 of the die carrier 100, shown in FIG. 4, or the guide passage 306 can be within the upper plate 102 of the die carrier, thus eliminating the necessity for the die carrier blcok 308. Alternatively, the guide passage 306 can be partially within the die carrier block 308 and portially within the upper plate 102.

The guide rod 304 is slidably mounted within the die carrier guide passage 306. Thus, it can be seen that the die member 134 can only move in a rectilinear manner relative to the die carrier 100. That is, the die member 134 can only move back and forth relative to the die carrier 100 as permitted by the movement of the guide rod 304 in the die carrier guide passage 306. In this manner, the die members are moved substantially perpendicular to the center line of the throat of the partial ring when being moved into engagement with a pipe section.

The inner surfaces of the side portion of the partial ring 40 facing the throat 10 are provided with three arcuate depressions on both sides of the pipe section. These depresions are positioned adjacent the die members 134 and 136. Depressions 160 and 171 serve as a neutral cam surface for receiving the head rollers 152 and 154, respectively, when the pipe-gripping mechanism is in its initial rest position. The depressions 162 and 163 serve as cam surfaces for urging the dies into gripping engagement with the pipe section with the ring 40 is rotated in the clockwise direction. The depressions 164 and 165, in like manner, urge the dies into gripping engagement with the pipe section when the ring 40 is rotated in the counterclockwise direction.

The "cam angle" of the cam surfaces 162, 163, 164, and 165 can vary depending the desired rectilinear movement of the die members. The preferred "cam angle" is about ½ to 5½ degrees, and more preferably 2 to 3 degrees, with 2½ degress being most preferred to obtain the proper engagement for proper pipe handling.

The "cam angle" is defined as the angle formed by lines originating at the center of rotation of the partial ring 40 and a point on a line perpendicular to the center line of the throat 10 and passing through the center of rotation and terminating at the point on the cam surface at which the cam follower is positioned when the dies are in contact with the pipe section. The "cam angle" is illustrated as "A" in FIG. 2. The angle "A" is constructed as follows using the cam surface 163 as illustrative. A point "B" on the cam surface 163 is found at which the dies engage the pipe. This point "B" is independent of the pipe diameter since different size die members 134 and 136 are used depending upon the pipe diameter. A line "C" is drawn between the center of rotation of the partial ring 40 and the point "B". A line "D" is then drawn between point "B" at the angle "A" from line "C" so that the line "D" intersects a line "E" which is perpendicular to the center line "F" of the throat at a point "G" which is between the center of rotation of the partial ring 40 and the neutral cam surface 162 which is adjacent point "B". The cam surface 163 and also the cam surface 165 form a portion of a circle having a center at point "G". The cam surfaces 162 and 164 are constructed in similar manner.

Referring now in more detail to the arrangement of the front and rear dies relative to the axis of rotation of the ring 40. It will be seen in FIG. 2 that a circle drawn about this axis may be divided into four quadrants by the center line "F" of the throat 10 and the line "E" passing through the axis of rotation perpendicular to the center line. The rear dies 148 and 150 are located in adjacent rear quadrants and the front dies 144 and 146 are located in adjacent front quadrants of the circle.

Mounted to the upper plate 4 of frame 2 is an arcuate brake band 170 having flange portions 172. Bolts 174 extend through openings (not shown) in the flanges 172 and serve to attach the brake band 170 to brackets 176. The brackets 176 are welded to the upper plate 4 and the bolts 174 are retained by nuts 178. The brake band 170 partially surrounds and frictionally engages the outer periphery of the upper plate 102 of the die carrier 100. The brake band 170 is restrained against vertical movement by retainers 180 which are bolted at 182 to the upper plate 4. Spring 184 is attached to brake band 170 at the rear end to slightly tension the brake band away from the die carrier 100.

The bolt head of the rear bolt 108 is elongated to form a spacer. The top of the elongated bolt head has a threaded opening which receives the threaded end of bolt 190. Pivotally mounted on bolt 190 is a retainer plate 192 which has an opening which receives backing pin 194. Backing pin 194 has shoulder 195 which retains the backing pin in retainer plate 192. Backing pin 194 can be inserted into one of openings 196 and 198 in the upper plate 102 of die carrier 100. Openings 196 and 198 are positioned one on either side of backing lug 200 when the opening 101 in the die carrier 100 is aligned with the opening 42 in the partial ring 40. The backing lug 200 is mounted in a recess 202 in the upper surface of the partial ring 40. The backing lug 200 is retained in place by bolt 204 which is threaded into a threaded opening 206 in the partial ring 40. The backing pin 194 abuts against the backing lug 200 and causes the partial ring 40 and die carrier 100 to move in unison with their openings 42 and 101, respectively, aligned while the opening 42 in the partial ring 40 is being aligned with the throat 10 in the frame.

In operation, the opening 42 in the partial ring 40 is aligned with the throat 10 in the frame 2 so that the pipe section may be inserted into the interior of the partial ring. In inserting the pipe, the door 26 is pivoted open to allow the pipe to be placed in the throat 10 and then closed. When inserted, the exterior surface of the pipe section comes into contact with the rear dies 148 and 150 of link members 134 and 136, respectively, and the longitudinal axis of the pipe section is approximately coincident with the axis of rotation of the partial ring 40. After the pipe section is in position, power is applied by the motor (not shown) to rotate the partial ring 40 either clockwise or counterclockwise. For the purpose of illustration, it will be assumed that the partial ring 40 is rotated in a clockwise direction.

As the ring 40 beings to rotate in a clockwise direction from the position shown in FIG. 1, the die carrier 100 will remain stationary because of the frictional engagement of the die carrier 100 with the brake band 170. Therefore, the cam surfaces 162 and 163 on the partial ring 40 will move relative to the cam followers 152 and 154 on the die members 134 and 136, respectively. Upon continued rotation of the ring 40, the cam surface 162 will cause the die member 134 to move rectilinearly in a direction dictated by the guide passage 306, and, in like manner, the cam surface 163 will cause the die member 136 to move rectilinearly in a similar manner. These movements of the die members 134 and 136 will being the dies into gripping engagement with the surface of the pipe section. With this arrangement, the force exerted by the dies on the pipe is concentrated at or near the center or rotation of the pipe section. Moreover, the force is evenly distributed and controlled so that the pipe is gripped tightly enough to allow proper torque to be applied without crushing or damaging the pipe.

After the dies are brought into contact with the pipe section, further relative movement between the cam followers 152 and 154 and the cam surfaces 162 and 163 is not possible. Accordingly, the die carrier 100 will begin to rotate in unison with the ring 40. The pipe section, being tightly gripped by the opposed dies against relative movement with respect to the die carrier, also will begin to rotate in a clockwise direction. This rotation may be continued for as many revolutions as may be required in order to make up or break apart a threaded connection between one end of the pipe section and another pipe section positioned in alignment therewith.

After the pipe section has been rotated sufficiently to make up or break apart the joint, the tong may be freed from the pipe section by rotating the ring 40 in the opposite direction, namely, in the counterclockwise direction in terms of this illustration, to position the cam followers 152 and 154 adjacent the neutral cam surfaces 160 and 161, respectively. With the parts in this position, the dies may be manually disengaged from the pipe section. Alternatively, springs (not shown) may be connected between the respective die member guides and die carrier blocks to disengage the dies from the pipe section. Thereafter, the ring 40 may be further rotated in the counterclockwise direction, if necessary, to position its opening 42 in alignment with the throat 10. The rotation of ring 40 will also cause die carrier 100 to be rotated back into its initial rest position by reason of the cooperation between backing pin 194 and backing lug 200 so that the pipe section may pass out of the tong.

As will be appreciated, the tong is also capable of rotating the pipe section in a counterclockwise direction. In order to accomplish this, the tong is operated in a manner substantially as described above, the only difference being that the partial ring 40 is rotated in the opposite direction and the cam surface 164 and 165 on the partial ring 40 cooperate with the cam followers 152 and 154.

It is to be understood that while one form of the invention has been illustrated, there are other forms which fall within the scope of the invention.

I claim:

1. A power tong assembly for engaging and rotating a pipe member and the like about its longitudinal axis, comprising a partial ring member rotatable about a center line and having an open throat portion for receiving said pipe member, said partial ring member further having a plurality of arcuate cam surfaces spaced interiorly about and oppositely with respect to said center line of said ring member and each having a radius of curvature extending to a cam radius point spaced from said center line of said ring member, a plurality of gripping members corresponding to the outside diameter of said pipe member and arranged within said ring member for movement relative to said center line of said ring member, a plurality of cam followers each arranged between said ring member and one of said gripping members for engaging said cam surfaces and urging corresponding ones of said gripping members substantially diametrically and oppositely toward said pipe member to align said center line of said ring member with said longitudinal axis of said pipe member in response to rotation of said ring member, said cam followers each further abutting one of said cam surfaces at a contact point defining the apex of a cam angle of not more that 5½ degrees when said gripping members engage said pipe member, said cam angle formed by a straight line commencing at said contact point and passing through said cam radius point and a second line commencing at said contact point and passing through said center line of said ring member, and driving means for rotating said partial ring about said center line of said ring member and for driving said gripping members substantially equally and oppositely against said pipe member as a function of the magnitude of said cam angles.

2. The power tong assembly described in claim 1, wherein said cam angle is not substantially less than ½ degrees.

3. The power tong assembly described in claim 2, wherein said cam angle is substantially 2½ degrees.

4. A power tong assembly as described in claim 1, further comprising:

guide means mounted to said partial ring member for causing said gripping members to move rectilinearly toward said pipe member.

5. A power tong assembly as described in claim 4, wherein said guide means comprises:

a guide passage, and a guide rod slidably mounted within said guide passage and having one end of said guide rod connected to one of said gripping members.

6. The power tong assembly as described in claim 4, wherein said guide means is aligned diametrically with said pipe member for slidably supporting said gripping member and for causing said griping members to move diametrically into gripping engagement with opposite sides of said pipe member.

* * * * *